US006190197B1

(12) United States Patent
Polgar et al.

(10) Patent No.: US 6,190,197 B1
(45) Date of Patent: Feb. 20, 2001

(54) FLOATING POLARIZED ELECTRICAL CONNECTOR ASSEMBLY

(75) Inventors: Gary E. Polgar, Bolingbrook; Joseph D. Comerci, Elmhurst, both of IL (US)

(73) Assignee: Molex Incorporated, Lisle, IL (US)

( * ) Notice: Under 35 U.S.C. 154(b), the term of this patent shall be extended for 0 days.

(21) Appl. No.: 09/426,834

(22) Filed: Oct. 26, 1999

(51) Int. Cl.[7] ..... H01R 13/60; H01R 13/66
(52) U.S. Cl. ..... 439/527; 439/532; 439/954
(58) Field of Search ..... 439/680, 527, 439/532, 954, 247, 248; 361/695, 831

(56) References Cited

U.S. PATENT DOCUMENTS

| | | | | |
|---|---|---|---|---|
| 3,456,231 | | 7/1969 | Paullus et al. . | |
| 4,032,209 | | 6/1977 | Rutkowski . | |
| 5,297,929 | * | 3/1994 | Horng | 361/695 |
| 5,330,360 | * | 7/1994 | Marsh et al. | 439/76 |
| 5,344,332 | | 9/1994 | Lopez et al. | 439/248 |
| 5,457,606 | * | 10/1995 | Young et al. | 361/737 |
| 5,460,530 | | 10/1995 | Toba et al. | 439/34 |
| 5,466,171 | * | 11/1995 | Bixler et al. | 439/680 |

* cited by examiner

*Primary Examiner*—Khiem Nguyen
*Assistant Examiner*—Hae Moon Hyeon
(74) *Attorney, Agent, or Firm*—Stephen Z. Weiss

(57) ABSTRACT

An electrical connector assembly is provided for interfacing between a component frame and a printed circuit board. The assembly includes a board connector for mounting on a surface of the printed circuit board and a frame connector mounted on the component frame. The connectors are mated in a mating direction generally perpendicular to the printed circuit board. Complementary interengaging tongues and grooves are provided between the frame connector and the frame and extend generally perpendicular to the mating direction for interengaging the frame connector with the frame. The tongues and grooves are of different sizes to polarize the frame connector relative to the frame. Latches are provided between the frame connector and the frame for holding the connector interengaged with the frame.

5 Claims, 3 Drawing Sheets

FLOATING POLARIZED ELECTRICAL CONNECTOR ASSEMBLY

FIELD OF THE INVENTION

This invention generally relates to the art of electrical connectors and, particularly, to an electrical connector assembly for mounting between a frame and a printed circuit board.

BACKGROUND OF THE INVENTION

A fairly wide variety of electrical components or electronic devices are mounted on substrates such as a printed circuit board within a computer. Such items can range from sophisticated computer chips to electro-mechanical components such as cooling fans. Although varying in sophistication or complexity, such items are electrically connected or interfaced with circuit traces on the printed circuit board.

With an electrical component such as a cooling fan, the fan/motor is mounted in a component frame. The frame is independently mechanically mounted to the printed circuit board. The fan/motor has electrical lead wires terminated to a component connector which hangs freely or "dangles" from the fan assembly. The component connector is mated with a header connector mounted on a surface of the printed circuit board independently of the mounting of the component frame on the board. Such a system not only requires multiple assembly steps, but the freely hanging connector which is terminated to the fan lead wires causes entanglement problems during shipping, handling and assembly. The present invention is directed to solving these problems by providing an electrical connector assembly wherein the component connector is integrated directly with the component frame.

SUMMARY OF THE INVENTION

An object, therefore, of the invention is to provide a new and improved electrical connector assembly of the character described.

Another object of the invention is to provide an electrical connector assembly for interfacing between a component frame and a printed circuit board.

In the exemplary embodiment of the invention, the assembly includes a board connector for mounting on a surface of the printed circuit board. A frame connector is provided for mounting on the component frame and for mating with the board connector in a mating direction generally perpendicular to the printed circuit board. Complementary interengaging tongue-and-groove means are provided between the frame connector and the frame and extends generally perpendicular to the mating direction for interengaging the frame connector with the frame. Complementary interengaging polarizing means are provided between the frame connector and the frame. Complementary interengaging latch means are provided between the frame connector and the frame for holding the connector interengaged with the frame.

As disclosed herein, the latch means is provided by at least one latch projection on the frame connector for snapping into a latch recess in the component frame. The latch projection is provided as a circular boss for engaging a circular recess in the frame, the boss having an oblique end face defining a lead-in ramp.

The polarizing means are provided by projections of different sizes on opposite sides of the frame connector for receipt in complementarily sized grooves in the component frame. The invention contemplates that the polarizing means be included directly in the tongue-and-groove means by variably sizing the respective tongues and grooves.

The component frame includes a receptacle for receiving thereinto the frame connector in a direction generally perpendicular to the mating direction. The tongue-and-groove means are disposed between opposite side walls of the receptacle and opposite sides of the frame connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 3:
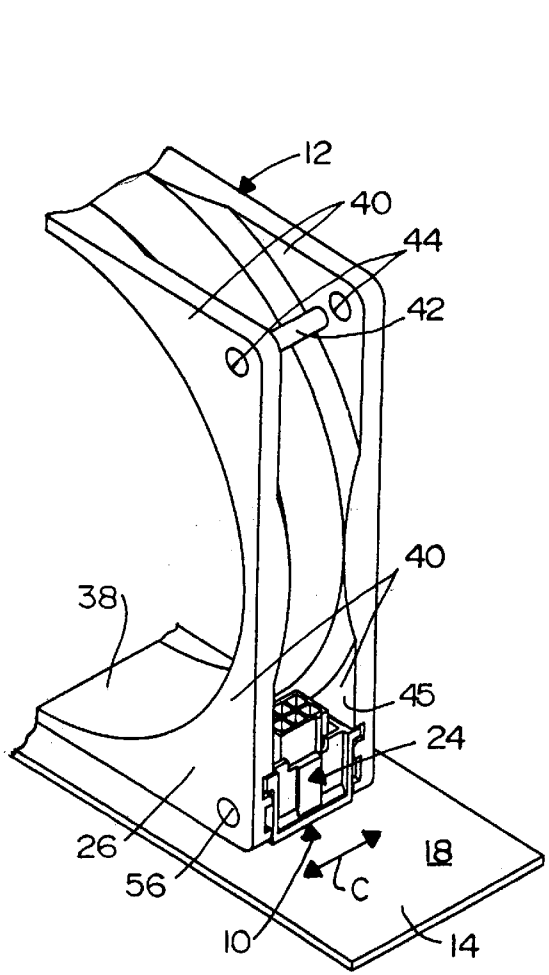
FIGS. 1–3 are sequential views of assembling the frame connector to the frame, the board connector to the printed circuit board and interfacing the two connectors while simultaneously mounting the frame to the board.
Figure 2:
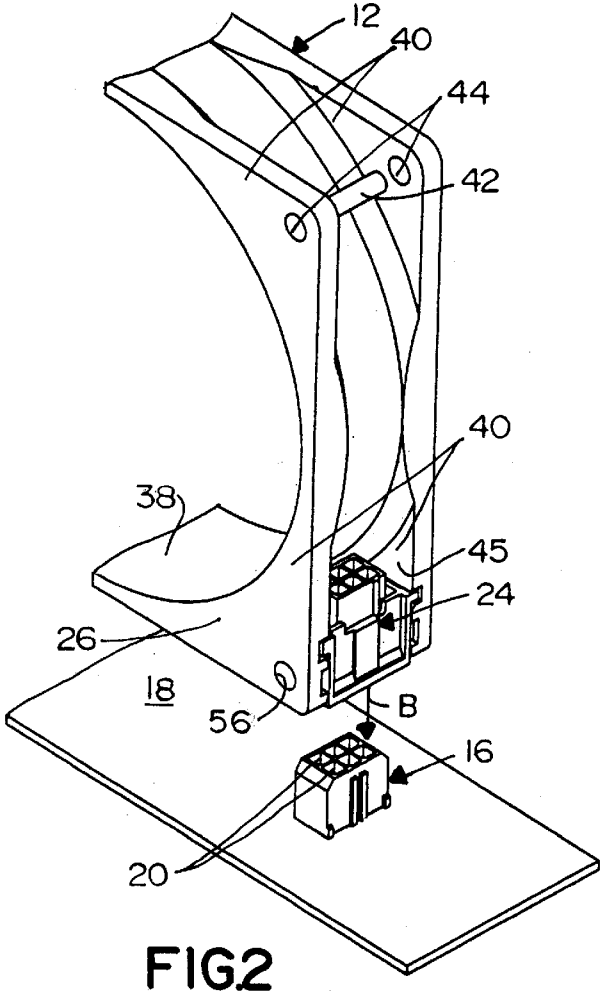
Figure 1:
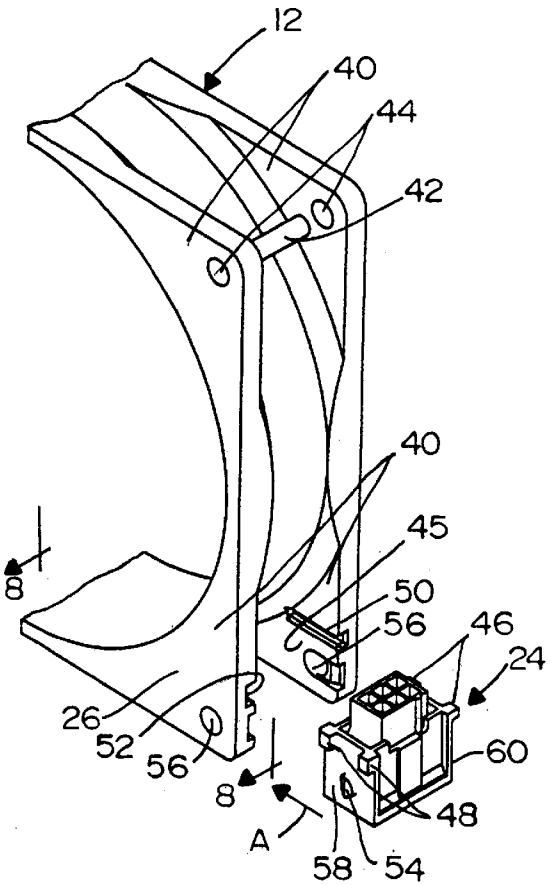
Figure 4:
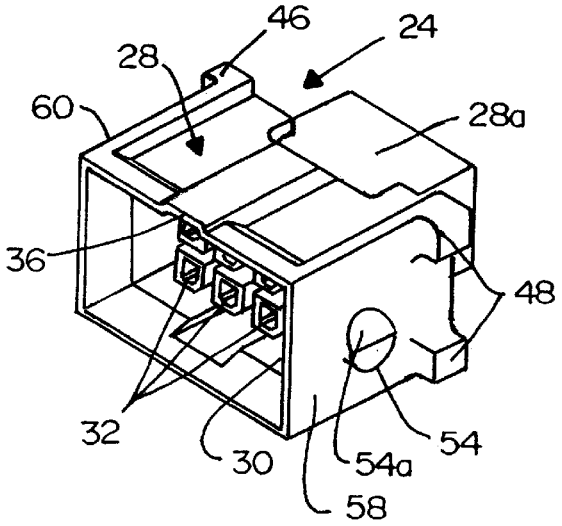
FIG. 4 is a bottom perspective view of the frame connector.

Referring to the drawings in greater detail, and first to FIGS. 1–3, the invention is embodied in an electrical connector assembly, generally designated 10 (FIG. 3) for interfacing between a component frame, generally designated 12, and a printed circuit board 14. The connector assembly includes a board connector, generally designated 16 (FIG. 2), for mounting on a surface 18 of printed circuit board 14. Board connector 16 is in the form of a plug connector having a plurality of passages 20 within which a plurality of terminals (not visible in the drawings) are disposed. The terminals are terminated to appropriate circuit traces on printed circuit board 14.

Electrical connector assembly 10 further includes a frame connector, generally designated 24, for mounting within a lower corner 26 (FIG. 1) of the frame in the direction of arrow "A". Once frame connector 24 is mounted within frame 12 as shown in FIG. 2, the frame connector is mated with board connector 16 in the direction of arrow "B" (FIG. 2). FIG. 3 shows the connectors fully mated, with frame 12 moved into flush engagement with top surface 18 of printed circuit board 14, as at 26.

Referring to FIGS. 4–7 in conjunction with FIGS. 1–3, frame connector 24 includes a one-piece housing, generally designated 28, unitarily molded of dielectric material such as plastic or the like. The housing has a bottom receptacle 30 (FIG. 4) which receives board or plug connector 16. A plurality of silos 32 (FIG. 4) project into receptacle 30 and are inserted into passages 20 (FIG. 2) of the board connector.

A plurality of terminals (not visible in the drawings) are mounted within silos 32 for interengagement with the terminals mounted within passages 20 of board connector 16. The terminals of the frame connector project into an upstanding housing portion 28*a* and are terminated to the conductors of electrical wires leading from a cooling fan/motor housed within frame 12, as described hereinafter. Housing 28 also has a polarizing channel 36 molded integrally with a side thereof for receiving a polarizing rib (not shown) on board connector 16 so that frame 12 can be mated in only one orientation with board connector 16.

Only one-half of component frame 12 is shown in FIGS. 1–3. The full frame is generally rectangularly shaped and forms a circular shroud 38 which surrounds a circular fan/motor (not shown). The frame has supporting flanges 40 at each of the four corners thereof. The supporting flanges are spaced-apart the width of shroud 38, and a supporting rib 42 extends between the flanges. A pair of apertures 44 are formed in the flanges for mounting the frame to a panel (not shown) which extends generally perpendicular to printed circuit board 14. The supporting flanges at comer 26 form a receiving area 45 for frame connector 24. It should be understood that the invention is applicable for component frames other than a cooling fan frame.

Generally, complementary interengaging tongue-and-groove means are provided between frame connector 24 and component frame 12 within receiving area 45 at corner 26 (FIG. 1) for interengaging the frame connector with the frame. The tongue-and-groove means extend in the assembly direction "A" (FIG. 1) and generally perpendicular to the mating direction "B" (FIG. 2).

More particularly, the tongue-and-groove means is provided by a pair of tongues 46 projecting outwardly from one side of frame connector 24 and a second pair of tongues 48 projecting outwardly from the opposite side of the frame connector.

Figure 5:
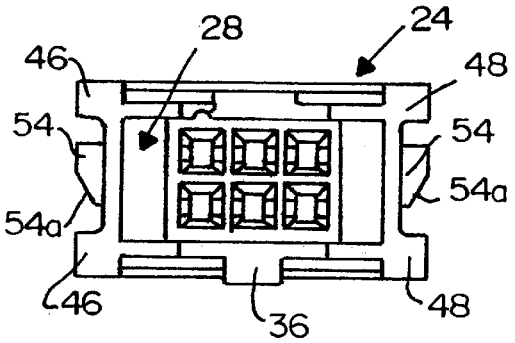
FIG. 5 is a top plan view of the frame connector.
Figure 6:
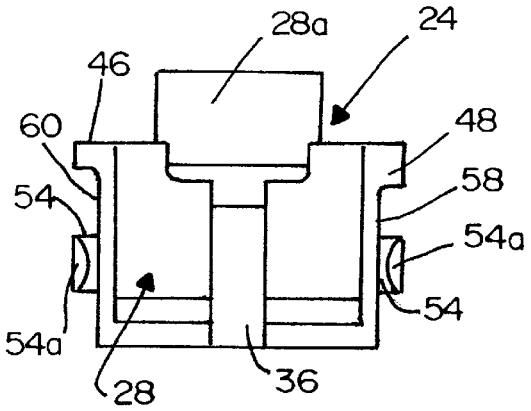
FIG. 6 is a rear elevation-. view of the frame connector.
Figure 7:
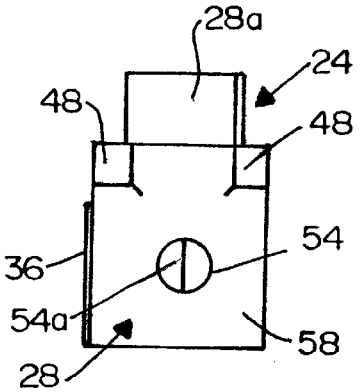
FIG. 7 is a side elevational view of the frame connector.
Figure 8:
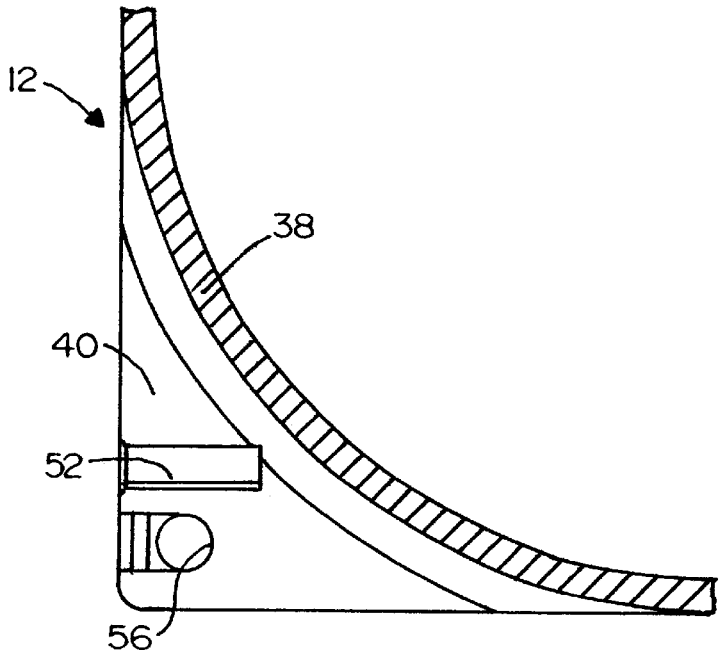
FIG. 8 is an enlarged fragmented vertical section taken generally along line 8—8 of FIG. 1.
Figure 9:
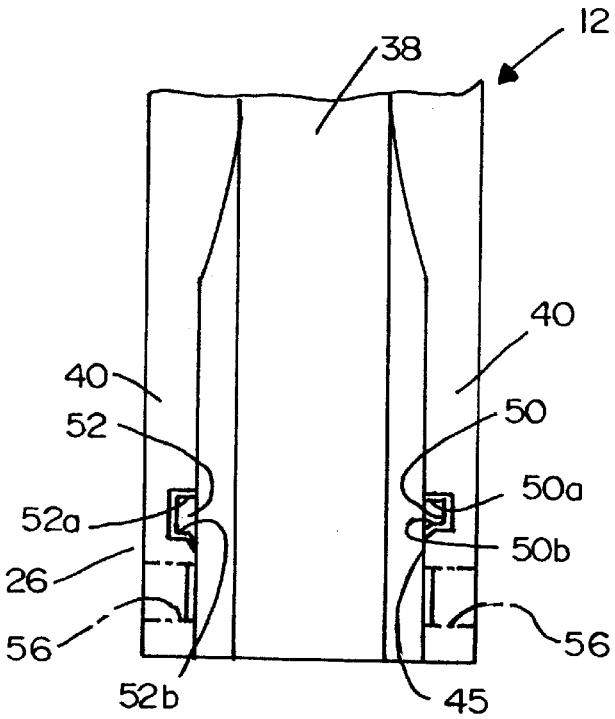
FIG. 9 is a fragmented front elevational view looking toward the left-hand side of FIG. 8.

Referring to FIGS. 8 and 9 in conjunction with FIGS. 1, 5 and 6, tongues 46 move into a groove 50 inside one of the flanges 40 of component frame 12, and tongues 48 move into a groove 52 inside the opposite flange 40 at lower comer 26 of the component frame. Tongues 46 move into groove 50 and tongues 48 move into groove 52 when frame connector 24 is assembled to component frame 12 in the direction of arrow "A" (FIG. 1). Therefore, with the tongues captured in the grooves, the tongues abut the opposite lateral sides 50*a*, 50*b*, 52*a* and 52*b* respectively of the grooves 50, 52 when the component frame 12 and frame connector 24 are mated with board connector 16 in the direction of arrow "B" (FIG. 2). The tongue and groove arrangement provides stability between the frame connector 24 and component frame 12 in either direction parallel to arrow B (FIG. 2), while also allowing for a floating relationship in either direction parallel to arrow "A" (FIG. 1). In other words, mating of connectors 24 and 16 to form connector assembly 10 (FIG. 3) draws component frame 12 onto top surface 18 of printed circuit board 14. In essence, the mating of the connectors simultaneously mounts the frame to the board.

Generally, complementary interengaging latch means are provided between frame connector 24 and component frame 12 for holding the connector interengaged with the frame. Specifically, a latch projection in the form of a circular boss 54 projects outwardly from each opposite side of frame connector 24 for snapping into a pair of circular latch recesses or holes 56 in flanges 40 of frame 12 at the lower corner 26 thereof. The relative diameter of the circular boss 54 and recess 56 can be modified to provide a floating relationship between the frame connector 24 and component frame 12 which is required in a blind mating application. At least a portion of the outer faces of latch bosses 54 are chamfered, as at 54*a*, to define lead-in ramps when the connector is inserted between flanges 40 in the direction of arrow "A" (FIG. 1). Component frame 12 typically is fabricated of various materials including plastic or some metals which are sufficiently flexible for lead-in ramps 54*a* to bias flanges 40 outwardly a sufficient amount for latch bosses 54 to snap into latch recesses 56 to hold the frame connector in its mounted position shown in FIG. 2 within receptacle 45 between flanges 40 of the frame. By modifying the relative dimension between the side walls 58, 60 of the frame connector 24 and the flanges 40, additional lateral floating movement can be allowed in either direction of double arrow "C" (FIG. 3).

Generally, complementary interengaging polarizing means are provided between frame connector 24 and component frame 12 to ensure that the connector is mounted within the frame in only one orientation. Specifically, the polarizing means is integrated directly into the tongue-and-groove means between the connector and the frame. The polarizing means can best be understood by comparing FIGS. 6 and 9, keeping in mind that FIG. 6 is a view of the rear of frame connector 24 and FIG. 9 is a view looking toward the front of the frame. With this understanding, it can be seen that tongues 46 which move into groove 50 are smaller or narrower than tongues 48 which move into groove 52. Correspondingly, groove 50 is smaller or narrower than groove 52. Consequently, if frame connector 24 is reversed and attempts are made to incorrectly assemble the connector the frame, larger or wider tongues 48 cannot enter smaller or narrower grooves 50, and an incorrect assembly is prevented.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector assembly for interfacing between a component frame and a printed circuit board, comprising:

a board connector for mounting on a surface of the printed circuit board;

a frame connector having opposite sides for mounting on the component frame and for mating with the board connector in a mating direction generally perpendicular to the printed circuit board;

complementary interengaging tongue-and-groove means between the frame connector and the frame and extending generally perpendicular to said mating direction for interengaging the frame connector with the frame, complementary interengaging poolarizing means between the frame connector and the frame included in the tongue and groove means; and complementary interengaging latch means between the frame connector and the frame comprising one latch projection in the form of a circular boss, with a boss diameter, projecting outwardly from each opposite side of the frame connector for snapping into a circular latch recesses, with a recess diameter, in the component frame, the boss diameter being smaller than the recess diameter which is required for holding the connector interengaged with the frame in a blind mating application.

2. The electrical connector assembly of claim 1 wherein said polarizing means in the tongue and groove means comprise projections of different sizes on opposite sides of the frame connector for receipt in complementarity sized grooves in the component frame.

3. The electrical connector assembly of claim 1 wherein said component frame includes a receiving area for receiving thereinto the frame connector in a direction generally perpendicular to said mating direction.

4. The electrical connector assembly of claim 3 wherein said tongue-and-groove means are disposed between opposite side walls of said receiving area and opposite sides of the frame connector.

5. The electrical connector assembly of claim 4 wherein the opposite side walls of said receiving area being separated by a given distance, the opposite sides of the frame connector being separated by a distance less than the given distance whereby the frame connector can move laterally in the frame.

* * * * *